United States Patent [19]

Hewes

[11] 4,049,057

[45] Sept. 20, 1977

[54] PARAFFIN CLEANER

[76] Inventor: William Stan Hewes, P.O. Box 3051, Midland, Tex. 79701

[21] Appl. No.: 728,298

[22] Filed: Sept. 30, 1976

[51] Int. Cl.[2] ..... E21B 37/00

[52] U.S. Cl. ..... 166/304; 166/312; 166/325

[58] Field of Search ..... 166/325, 312, 304, 334, 166/302; 175/71

[56] References Cited

U.S. PATENT DOCUMENTS

| | | | |
|---|---|---|---|
| 2,293,442 | 8/1942 | Montgomery | 166/325 |
| 2,300,348 | 10/1942 | Dana | 166/304 |
| 2,704,979 | 3/1955 | Willigen | 166/304 |
| 2,770,307 | 11/1956 | Deerdoff | 166/302 |
| 3,014,531 | 12/1961 | Weaver | 166/325 |
| 3,085,629 | 4/1963 | Henderson | 166/325 |
| 3,102,590 | 9/1963 | Grounds | 166/325 |
| 3,361,205 | 1/1968 | Waldron | 166/325 |
| 3,376,936 | 4/1968 | Tomlin | 166/334 |
| 4,011,906 | 3/1977 | Alexander et al. | 166/105 |

*Primary Examiner*—James A. Leppink
*Attorney, Agent, or Firm*—Wendell Coffee

[57] ABSTRACT

A valve unit is placed in the eduction tube of an oil well. The unit has two valves therein, one to discharge fluid from the eduction tube into the annulus between the tube and the casing and the other to receive fluid from the annulus into the eduction tube. The ball of the valves are held against a seat by cupped or "Belville" washers. The valves are located within an enlarged cylindrical portion of the eduction tube.

7 Claims, 6 Drawing Figures

PARAFFIN CLEANER

CROSS-REFERENCE TO RELATED APPLICATIONS:

None. However, applicant filed the following disclosure documents:

U.S. Pat. No. 041030, May 15, 1975;
U.S. Pat. No. 041420, June 2, 1975;
U.S. Pat. No. 042796, Aug. 4, 1975;
U.S. Pat. No. 049514, May 20, 1976;

documents concern this application; therefore, by separate paper, it is respectfully requested that the documents be retained.

BACKGROUND OF THE INVENTION:

1. Field of the Invention.

This invention relates to oil wells and more particularly to pressure relief valves in the eduction tube used for removal of paraffin from existing oil wells.

2. Description of the Prior Art.

A problem exists in producing oil from certain formations with the paraffin coating out on the inside of the eduction tube. Normally, the oil in the producing formation is at an elevated temperature so the paraffin within the crude oil is melted. As the petroleum is brought to the surface, the oil cools and the paraffin precipitates out, normally upon the side of the eduction tube causing a problem. Therefore, the bottom portion of the eduction tube will normally be clear of precipitated paraffin, but the upper portion will have paraffin therein.

It has been known for some time that a pressure relief valve could be placed in the eduction tube below the point where the paraffin is formed and heated oil pumped into the eduction tube from the surface to clear the paraffin out. Such a method with equipment is shown in DANA, U.S. Pat. No. 2,300,348. Instead of using heated oil, different solvents could be pumped in from the surface to dissolve the paraffin.

Problems exist when pulling the eduction tube (or ramming it into the well) with projections projecting from the well. Therefore, various sturdy tools are necessary. Sometime large sections are used, e.g., WALDRON, U.S. Pat. No. 3,361,205.

Cupped or Belville washers were known before this invention.

At the time of filling this application, applicant was aware of the following U.S. patents: Abbott U.S. Pat. No. 3,152,645; Grounds U.S. Pat. No. 3,102,590; Weaver U.S. Pat. No. 3,014,531; Henderson U.S. Pat. No. 3,085,629; Tomlin U.S. Pat. No. 3,376,936; Dana U.S. Pat. No. 2,415,729; Deerdoff U.S. Pat. No. 2,770,307; Willigen U.S. Pat. No. 2,704,979; Hubbard U.S. Pat. No. 3,169,587;

SUMMARY OF THE INVENTION:

1. New and Different Function.

I have invented a valve which operates much better because a stronger and more easily adjustible spring can be used. By using cupped or Belville washers it is easier to obtain a stouter spring to bias the ball valve against its seat and, also, to adjust the pressure by which the valve is pressed against its seat. Also, by using a cylindrical section which is eccentric to the bore, a very sturdy arrangement is produced.

The cupped Belville washers may be placed singularly in opposite relationship and, therefore, are easier to compress than if they are placed in pairs, one pair upward another downward. The washers may be used in triplets to obtain a stouter spring.

The washers are placed in a cup for easier handling within the bore.

In offshore drilling sites, it is particularly important that none of the well fluids be spilled or discharged into the ocean. This is subjected to many government regulations as well as the natural concern for the environment, making it highly undesirable that any well fluids be spilled into the ocean. Therefore, I have provided a way that all of the fluids used in paraffin removal are captured. The annular space between the casing and the eduction tube is piped into a tank. Instead of having only a single pressure relief valve which permits flow outward from the eduction tube (an out pressure relief valve), a second pressure relief valve is used which permits pressure to flow from the annulus into the eduction tube (an in pressure relief valve). Thus, by using these two pressure relief valves that I have achieved new results not previously achieved, i.e., a method of treating the paraffin in the eduction tube without any loss of fluids or without the discharge of any treatment fluids or well fluids into the environment.

Therefore, the parts in combination achieve more than the sum of the parts individually. I.e., by taking common parts, such as pressure relief valves, in my unique combination, I am able to achieve results never before achieved. The results achieved are the protection of the environment from pollution.

2. Objects of the Invention.

An object of this invention is to remove paraffin from wells, and otherwise treat wells.

Another object is to remove paraffin from offshore wells without polluting the environment.

Other objects are to achieve the above with a device that is sturdy, compact, durable, simple, safe, efficient, and reliable, yet inexpensive and easy to manufacture, install, adjust, operate, and maintain.

Further objects are to achieve the above with a method that is rapid, efficient, and inexpensive, and does not require highly skilled people to install, adjust, operate, and maintain.

The specific nature of the invention, as well as other objects, uses, and advantages thereof, will clearly appear from the following description and from the accompanying drawing, the different views of which are not to the same scale.

Figure 1:
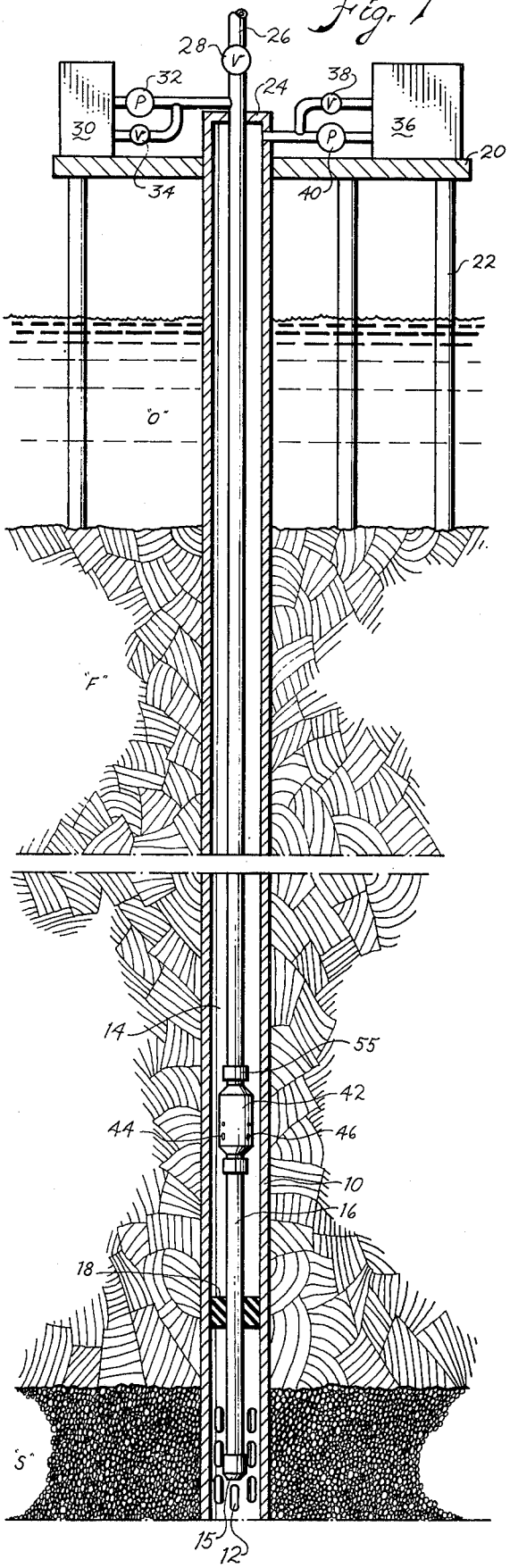
FIG. 1 is a schematic representation of an offshore oil well.

DESCRIPTION OF THE PREFERRED EMBODIMENT:

Referring to the drawing and more particularly to FIG. 1, there may be seen represented an offshore oil well. Basically, the well will include casing 10 which extends through ocean "0" and also ocean floor "F" into the producing strata "S", location of the petroleum containing formation. The casing 10 will have a plurality of openings 12 in the bottom or opposite the strata S to permit the oil to flow into annulus 14, which is the space between eduction tube 16 and the casing 10. The casing will be cemented or sealed to the well bore at its exterior so there will be no loss of fluids from the strata S to the ocean 0. Externally sealing the casing to the bore is old and well known and, therefore, is not discussed at this point.

Packer 18 between the eduction tube 16 and the casing 10 is shown. Foot valve 15 at the foot of the eduction tube 16 permits fluid flow from the annulus into the eduction tube, but prohibits fluid from the eduction tube back into the annulus. It is understood that the eduction tube 16 is open into the annulus below the packer 18. Although the drawing does not show a pump with the associated sucker rod and pump jack, it will be understood that if the well lacks sufficient pressure to bring the fluids to the surface, the pump would be included. However, whether or not a sucker rod is present does not alter the invention since the use of valve units with pumped wells is known.

As shown herein, platform 20 is located on pilings 22 in the ocean 0. The eduction tube 16 extends through well head 24 at the platform 20 and has conduit 26 for the produced oil to be transported away. Valve 28 in the conduit 26 is provided to isolate the eduction tube 16 from the conduit 26 during processing.

Processing fluid for paraffin or other well treatment is conveniently placed in treatment tank 30. The tank 30 is connected to the eduction tube 16 by pump 32, which forms a means for introducing the treating fluid within the tank 30 into the eduction tube 16 under pressure. Valve 34 provides means for connecting the eduction tube 16 back to the tank 30.

Slop tank 36 is provided on the platform 20. It is connected to the annulus 14 by valve 38. Also, pump 40 connects the slop tank 36 to the annulus so that the contents of the slop tank can be pumped into the annulus.

The eduction tube 16 is placed within the well. Valve unit 42 is placed within the eduction tube. The valve unit will be described in detail later, but at the present time it is sufficient to say it has out pressure relief valve 44 by which fluids within the eduction tube may be discharged into the annulus 14.

Those with ordinary skill in the art will understand that if the valves 28 and 34 are closed and the slop tank valve 38 is open and the pump 32 is operated, fluid from the treatment tank 30 is pumped into the eduction tube. Then, the fluid within the eduction tube will be expelled through the out pressure relief valve 44 into the annulus 14 and force out fluid in the annulus through the open slop tank valve 38 into the slop tank 36. By measuring the fluid in the treatment tank 30 or by the use of flow meters, it can be determined when a fixed amount of treatment fluid has been pumped into the eduction tube, but, certainly, less fluid can be pumped into the eduction tube than the volume of the eduction tube from the surface, which would be the platform 20, to the valve unit 42. Therefore if this volume is filled substantially with the treatment fluid, it will be understood that any paraffin in the eduction tube would be dissolved either by heat from hot oil treatment or by the solvents in the solvent treatment. The contents of the eduction tube would not be spilled into the ocean, but would be captured in the annulus where the neutral contents of the annulus would be flowed into the slop tank 36. Thus, it may be seen that the paraffin can be dissolved from the eduction tube.

After the contents are dissolved from the eduction tube, the treatment material can be washed back into the treatment tank 30. This is accomplished by opening the treatment valve 34 and closing the slop valve 38. Then the contents of the slop tank can be pumped back into the annulus by operation of the pump 40. The valve unit 42 also contains in pressure relief valve 46. As the pressure in the annulus 14 exceeds the pressure in the eduction 16, the flow will be from the annulus into the eduction tube. Assuming that the fluids will stratify and remain in their strata, it may be seen that the same fluid which was pumped from the eduction tube through out pressure relief valve 44 and now will be pumped back into the eduction tube through the in pressure relief valve 46. Therefore, it may be seen that all of the treatment fluids and materials used will be always contained within the eduction tube 16 or the treatment tank 30. All of the contents of the eduction tube will be contained either in the eduction tube or the casing 10. In any event any neutral fluid in the casing, such as sea water, will be contained within either the casing itself or the slop tank 36, leaving no fluids whatsoever being discharged into the environment.

Figure 2:
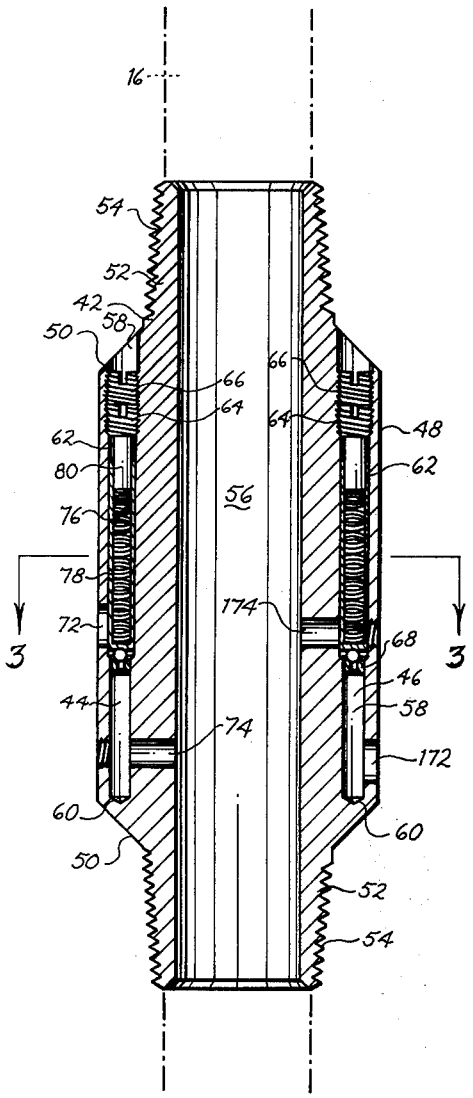
FIG. 2 is an axial sectional view of a valve according to this invention, taken substantially on line 2—2 of FIG. 3.
Figure 6:
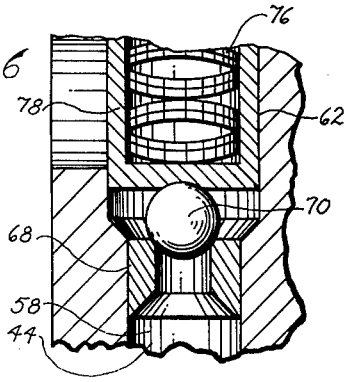
FIG. 6 is an enlarged detail of the valve ball and valve seat in a portion of the out pressure relief valve as seen in FIG. 2.
Figure 3:
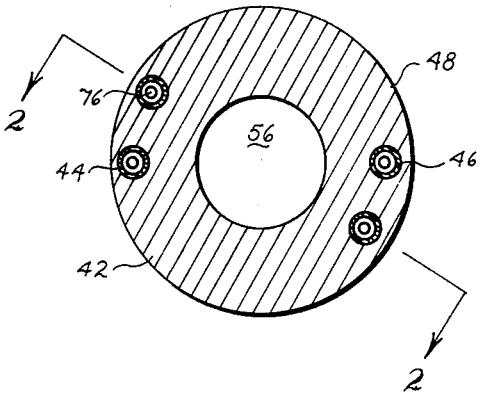
FIG. 3 is a cross sectional view of a valve according to this invention taken substantially on line 3—3 of FIG. 2.

Referring now more particularly to FIGS. 2, 3, and 6, the valve unit containing the in pressure relief valve 46 and out pressure relief valve 44 are more particularly described. The valve unit 42 includes as one of its principal parts a cylindrical external portion 48. This cylindrical exterior portion has a greater diameter than the diameter of the eduction tubing 16 as is schematicaly illustrated by broken lines in FIG. 2. At the top and bottom of the cylindrical external portion 48, there is shoulder 50 separating the external portion from neck 52 which has external threaded portions 54. Each of the threaded portions 54 forms a joint for connecting the valve unit 42 to the eduction tube, at both top and bottom. The connection is made by cuffs or collars 55 as seen in FIG. 1, as is common in well construction. The valve unit has central bore 56 therethrough. The threaded portion is concentric with the central bore 56. The central bore may be eccentric to the cylindrical external portion 48. However, if it is eccentric, it will be understood that the axis of the central bore 48 will be parallel to the axis of the bore 56. The out pressure relief valve 44 is in the cylindrical external portion of the tubular body of the valve unit 42.

The out pressure relief valve 44 is within valve bore 58 in the cylindrical exterior portion 48. The bore begins as illustrated at the upper shoulder 50 and terminates at the bottom 60 which is short of the bottom shoulder 50. The upper portion is enlarged to form a spring bore 62. The top of the bore within the spring bore 62 is plugged by plug 64. The plug 64 is held securely in place by lock plug 66 immediately above it.

Valve seat 68 is located within the valve bore 58 as illustrated. Ball 70 rests upon the valve seat between the valve seat 58 and the plug 64. Outside opening 72 in the form of a slot opens from outside of the valve unit 42 into the valve bore in the spring bore 62 portion thereof. I.e., the outside opening 72 is between the valve seat 68 and the plug 64. Bore opening 74 extends from the valve bore 58 and the cylindrical bore 56 on the other side of the valve seat 68 from the outside opening 72, which is, in fact, between the valve seat 68 and the bottom 60. The bore opening 74 is conveniently made by drilling a hole from outside the cylindrical portion 48 into the cylindrical bore 56 and then plugging the drilled hole with a threaded plug which is welded in place and ground flush inasmuch as it is not necessary to remove this plug once it is in place.

A series of cupped or Belville washers 76 are placed within cup 78. The number of washers placed within the cup and their arrangement will determine the strength with which the ball valve 70 is pressed against its seat 68. As illustrated, they have been shown with two Belville washers facing one direction and two facing in the opposite direction. Those skilled in the art and familiar with Belville washers will understand that different arrangements will result in different forces against the ball valve. The washers are held in place with plunger 80 at the open end of the cup 78. Once the washers are assembled within the cup, the cup 78 is placed within the spring bore 62 on top of the ball 70 and the bore plugged with plug 64. The plug is tightened against the spring assembly to exert the correct amount of force against the ball 70. The term "spring assembly" includes the cup 78, the Belville washers 76 therein and the plunger 80.

Those skilled in the art will understand that a torque wrench would be used on plug 64 so that the correct predetermined force would be exerted upon the valve.

Therefore, it will be understood that when the pressure within the bore 56, which is the pressure within the eduction tube 16, exceeds a predetermined amount as set by the plug 64 and the arrangement of the valve washers 76, the valve balls will rise from the seat 68 and permit a flow of fluid from the bore 56 through the bore opening 74 and thus through the outside opening 72 into the annulus 14. This is the operation when the pump 36 is pumping treatment fluid from the tank 30 into the eduction tube 16.

I have found it desirable to include two out pressure relief valves 44 to provide the desired flow from the eduction tube 16 into the annulus 14. Likewise, two in pressure relief valves 46 are provided. The two in pressure relief valves are substantially the same as the out pressure relief valve 44 except for the reversal of the slots 172 and bore openings 174. I.e., the in pressure relief valves will also have a valve bore 58 extending to the bottom 60 which is above the bottom shoulder 50. There will also be an enlarged spring bore 62 above it enclosed with the lug 64 held in place with a lock plug 66. The valve seat 68 will be located at the top of the valve bore 58 with ball valve 70 between the valve seat and the plug. However, as stated, the outside opening 172 of the in pressure relief valve 46 is located below the valve seat, i.e., between the valve seat and the bottom 60. The bore opening 174 is located on the other side of the valve seat 68 from the outside opening 172, however, in this instance, the other side of the valve seat will be between the valve seat and the plug 64.

Thus it may be seen that with the arrangement as described that if the pressure on the outside of the valve unit 42 exceeds the pressure within the bore 56 by that amount as set by the in pressure relief valve plug 64 that there will be a flow from the annulus into the eduction tube.

Figure 4:
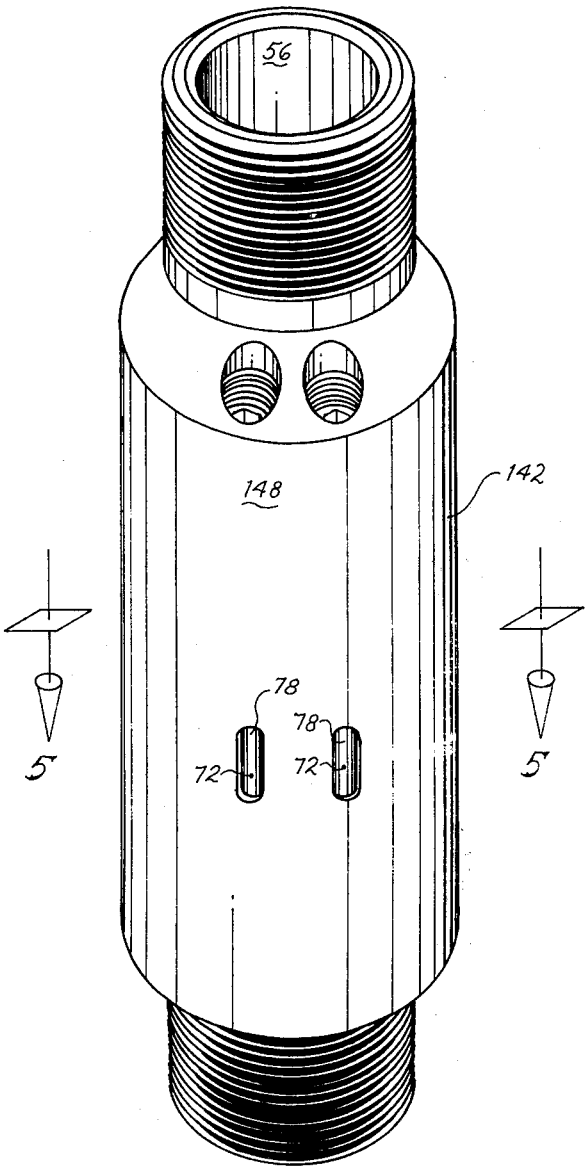
FIG. 4 is a perspective view of a second or eccentric embodiment of this invention.
Figure 5:
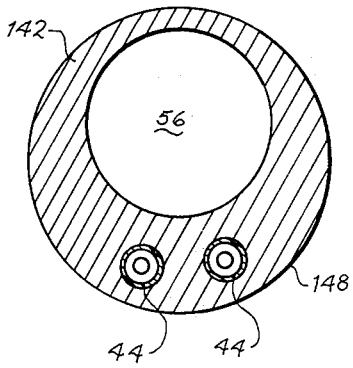
FIG. 5 is a cross sectional view of the embodiment of FIG. 4 taken substantially on plane 5—5 of FIG. 4.

It will be understood that with land wells, (wells drilled on dry land), the spilling of oil does not pollute such a wide area of the environment as does offshore situations; therefore, it is not necessary to have the in pressure relief valve 46. Valve unit 142, (FIGS. 4 and 5), which is designed only to have out pressure relief valves 44, does not need to have as large configuration as the cylindrical external portion 48 as does the offshore unit.

I have found it desirable on the land unit to use one having the external cylindrical portion eccentric to the eduction tube 16. Therefore, in a situation such as this, the external cylindrical portion has an axis which is parallel to but eccentric from the cylindrical bore which, of course, will be aligned or concentric with the eduction tube. The amount of eccentricity is so that one side of the external cylindrical portion 148 is approximately tangent to the eduction tube 16 or certainly to the cuffs on the eduction tube. As before, to obtain better flow, I use two out pressure relief valves 144 which are identical to out pressure relief valves 44 as described in connection with offshore unit previously described.

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

As an aid to correlating the terms of the claims to the exemplary drawing, the following catalog of elements is provided:

| | | | |
|---|---|---|---|
| 10 | casing | 54 | threaded portion |
| | | 55 | collars |
| 12 | opening | 56 | central bore |
| 14 | annulus | 58 | valve bore |
| 15 | foot valve | 60 | bottom |
| 16 | eduction tube | 62 | spring bore |
| 18 | packer | 64 | plug |
| 20 | platform | 66 | lock plug |
| 22 | piling | 68 | valve seat |
| 24 | well head | 70 | ball |
| 26 | conduit | 72 | outside opening, slot |
| 28 | valve | 74 | bore opening |
| 30 | tank, treatment | 76 | cupped washers |
| 32 | pump | 78 | cup |
| 34 | valve | 80 | plunger |
| 36 | slop tank | "O" | ocean |
| 38 | valve | "F" | ocean floor |
| 40 | pump | "S" | producing strata |
| 42 | valve unit | 142 | valve unit |
| 44 | out-pressure R.V. | 144 | out-pressure R.V. |
| 46 | in-pressure R.V. | 148 | cylindrical portion |
| 48 | cyl. external portion | 172 | slots |
| 50 | shoulder | 174 | bore opening |
| 52 | neck | | |

I claim as my invention:

1. In an oil well having a. an eduction tube within b. a casing;

AN IMPROVED VALUE UNIT COMPRISING:

c. a tubular body, d. said body having a cylindrical exterior portion having an axis, e. said body having a cylindrical bore therethrough having an axis parallel to, but eccentric from, said exterior portion axis,
f. joint means on each end of the body for connecting the body to the eduction tube,
g. said joint means concentric with said bore, and
h. out pressure relief valve means in said body for flowing high pressure fluids from said bore,
j. in pressure relief valve means in said body for flowing high pressure fluids into said bore.

2. The invention as defined in claim 1 wherein said valve means includes
j. a valve bore into said body with an axis parallel to said body axis,
k. a plug plugging said valve bore,
m. a valve seat in said valve bore,
n. a ball on said seat between the seat and plug,
o. an outside opening from said valve bore to the outside of the body on one side of said valve seat,
p. a bore opening from said valve bore to the cylindrical bore on the other side of said valve seat from said outside opening,
q. an elongated cup in the valve bore extending from said plug to said ball, and
r. a plurality of cupped washers in said cup.

3. In an oil well having
a. an eduction tube within
b. a casing;

AN IMPROVED VALUE UNIT COMPRISING:
c. a tubular body,
d. said body having a cylindrical exterior portion having an axis,
e. said body having a cylindrical bore therethrough having an axis parallel to said exterior portion axis,
f. joint means on each end of said body for connecting the body to the eduction tube,
g. said joint means concentric with said bore,
h. a valve bore into said body with an axis parallel to said body axis,
j. a plug plugging said bore,
k. a valve seat in said bore,
m. a ball on said seat between the seat and the plug,
n. an outside opening from said valve bore to the outside of the body between the valve seat and plug,
o. a bore opening from said valve bore to the cylindrical bore on the other side of the valve seat from said plug,
p. an elongated cup in the valve bore extending from said plug to said ball, and
q. a plurality of cupped whashers in said cup,
r. a second valve bore into said body with an axis parallel to said body axis,
s. a plug plugging said second bore,
t. a valve seat in said second bore,
u. a ball on said seat between the seat and plug,
v. a bore opening from said second valve bore to the cylindrical bore between said valve seat and plug,
w. an outside opening from said second valve bore to the outside of the other side of the said valve seat,
x. an elongated cup in the second valve bore extending from said plug to said ball, and
y. a plurality of cupped washers in said cup.

4. In an offshore oil well having
a. an eduction tube, within
b. a casing;

AN IMPROVED METHOD OF TREATING A WELL FROM WITHIN THE EDUCTION TUBE WITHOUT POLLUTING THE ENVIRONMENT COMPRISING:
c. placing
i. an in pressure relief valve for flow from the annulus of the casing into the tubing adjacent to
ii. an out pressure relief valve for flowing from the tubing into the annulus,
d. pumping treatment fluids into the eduction tube, thus
e. opening the out pressure relief valve so that the eduction tube contents are pumped into the annulus between the tube and casing, then
f. pumping neutral fluids into the annulus, thus
g. opening the in pressure relief valve so that the eduction tube contents are returned thereto.

5. The invention as defined in claim 4 with an additional limitation of
h. wherein the volume of treatment fluid pumped into the eduction tube is less than the volume of that portion of the eduction tube from the surface to the out pressure relief valve.

6. The invention as defined in claim 4 with an additional limitation of
h. said annulus being connected at the surface to a tank so that the contents of the annulus is pumped into a tank at the time of pumping in the treatment fluid and the contents of the tank is the neutral fluid which is returned to the annulus in the step described above.

7. The invention as defined in claim 6 with an additional limitation of
j. wherein the volume of treatment fluid pumped into the eduction tube is less than the volume of that portion of the eduction tube from the surface to the out pressure relief valve.

* * * * *